US011785689B2

(12) United States Patent
Delvaux

(10) Patent No.: US 11,785,689 B2
(45) Date of Patent: Oct. 10, 2023

(54) LIGHT SYSTEM WITH ANTI-PARALLEL LEDS

(71) Applicant: Schreder S.A., Brussels (BE)

(72) Inventor: Michel Delvaux, Henri-Chapelle (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/431,631

(22) PCT Filed: Feb. 21, 2020

(86) PCT No.: PCT/EP2020/054677
§ 371 (c)(1),
(2) Date: Aug. 17, 2021

(87) PCT Pub. No.: WO2020/173836
PCT Pub. Date: Sep. 3, 2020

(65) Prior Publication Data

US 2022/0124891 A1 Apr. 21, 2022

(30) Foreign Application Priority Data

Feb. 25, 2019 (NL) ..... 2022633

(51) Int. Cl.
*H05B 45/42* (2020.01)
*H05B 45/3725* (2020.01)

(52) U.S. Cl.
CPC ..... *H05B 45/42* (2020.01); *H05B 45/3725* (2020.01)

(58) Field of Classification Search
CPC .. H05B 45/3725; H05B 47/155; H05B 47/10; H05B 47/175; H05B 45/395; H05B 45/10; H05B 45/20; H02M 5/04
See application file for complete search history.

(56) References Cited

U.S. PATENT DOCUMENTS 10,136,485 B1 * 11/2018 Coetzee ..... H05B 45/42
2006/0221637 A1 * 10/2006 Chikugawa ..... H05B 45/20 257/E25.02

(Continued)

FOREIGN PATENT DOCUMENTS

CN 104170528 B * 10/2017 ..... H05B 33/08
JP 2011054538 A * 3/2011 ..... H05B 33/0815
WO WO-2010041169 A1 * 4/2010 ..... H05B 33/0818

OTHER PUBLICATIONS

PCT International Search Report and Written Opinion, Application No. PCT/EP2020/054677, dated May 12, 2020, 12 pages.

*Primary Examiner* — Abdullah A Riyami
*Assistant Examiner* — Syed M Kaiser
(74) *Attorney, Agent, or Firm* — McDonnell Boehnen Hulbert & Berghoff LLP

(57) ABSTRACT

Example embodiments relate to light system with anti-parallel LEDs. One example light system includes a driver configured to generate a DC current. The light system also includes at least one first group, a first group thereof including a first and a second LED connected in anti-parallel. The light system also includes at least one second group, a second group thereof including a first and a second LED connected in anti-parallel. The at least one second group is connected in series with the at least one first group. Additionally, the light system includes control circuitry configured for selectively operating the first and second group in at least one first one and at least one second mode.

15 Claims, 12 Drawing Sheets

(56) References Cited

U.S. PATENT DOCUMENTS

| | | | | |
|---|---|---|---|---|
| 2011/0115403 | A1* | 5/2011 | De Smit | H05B 45/3575 315/291 |
| 2011/0241551 | A1 | 10/2011 | Mcrae | |
| 2012/0146519 | A1* | 6/2012 | Briggs | H05B 45/20 315/192 |
| 2013/0284908 | A1* | 10/2013 | Rossi | G01J 1/0411 250/221 |
| 2014/0005555 | A1* | 1/2014 | Tesar | A61B 17/00 600/476 |
| 2014/0126261 | A1* | 5/2014 | Newman, Jr. | H05B 39/04 363/128 |
| 2014/0145630 | A1 | 5/2014 | Peng | |
| 2014/0333219 | A1 | 11/2014 | Zijlstra et al. | |
| 2016/0262230 | A1 | 9/2016 | Park | |
| 2018/0040787 | A1* | 2/2018 | Herrmann | H01L 33/60 |

* cited by examiner

| Q1 | Q2 | Q3 | Q4 | 1 | 2 | Current flowing | Mode |
|---|---|---|---|---|---|---|---|
| on | off | off | on | on | off | A to B | M1 |
| off | on | on | off | off | on | B to A | M2 |

| Q1 | Q2 | Q3 | Q4 | Q5 | Q6 | 1(G1) | 2(G1) | 1(G2) | 2(G2) | Current flowing | Mode |
|---|---|---|---|---|---|---|---|---|---|---|---|
| on | off | off | on | off | on | on | off | off | off | A to B | M1' |
| off | on | on | off | on | off | off | on | off | off | B to A | M2' |
| on | off | on | off | off | on | off | off | on | off | B to C | M1'' |
| off | on | off | on | on | off | off | off | off | on | C to B | M2'' |

LIGHT SYSTEM WITH ANTI-PARALLEL LEDS

CROSS-REFERENCE TO RELATED APPLICATIONS

The present application is a national stage entry of PCT/EP2020/054677 filed Feb. 21, 2020, which claims priority to NL 2022633 filed Feb. 25, 2019, the contents of each of which are hereby incorporated by reference.

FIELD OF INVENTION

The field of the invention relates to light systems, in particular luminaires, and more in particular outdoor luminaires such as outdoor luminaires for streetlights.

BACKGROUND

Existing luminaires typically comprise a plurality of light elements, one or more drivers functioning as one or more regulated current sources for driving the plurality of light elements, and a control module for controlling the driving.

By using a control module, modern lighting systems offer a plurality of operating and control possibilities for adjusting or optimizing lighting conditions. For example, brightness, light color and spectrum, light temperature, etc. can be set depending on the situation. For example, it is known to control the driving of a plurality of red, green and blue LEDs to generate white light.

Some existing systems use separate drivers for driving different groups of LEDs of the light system. Such systems have the disadvantage of an increased space and cost for the drivers.

Other existing systems, sometimes called multi-channel or multi-branch systems, use a single driver in combination with switching elements (or other control circuitries) which are controlled by a control module to switch on/off certain light elements independently of other light elements. Often pulse width modulation techniques are used to control the switching elements in order to switch on/off a channel or branch with one or more lighting elements. In such systems, the power that needs to be provided by the single driver is the sum of the power that is needed in each of the branches or channels. In other words, the driver has to be able to cope with power changes.

In yet other existing light systems, a first string of first LEDs is connected in anti-parallel with a second string of second LEDs, and the current is sent alternatively through the first and the second string of LEDs. Such systems have the disadvantage that, when the first string is activated, and there is a first voltage over the first and second string which is equal to the sum of the forward voltages of the first LEDs of the first string, there is a risk of over-tension over one of the non-activated second LEDs, as the first voltage may not be distributed evenly over the non-activated second LEDs.

In view of the considerations above, there is a need for an improved light system which can be well controlled and which is simple and robust.

SUMMARY

The object of embodiments of the invention is to provide a light system with a reduced number of connection lines and/or bridges which can be controlled in a simple and robust manner.

According to a first aspect, there is provided a light system, comprising a driver configured to generate a DC current, at least one first group of LEDs and at least one second group of LEDs, and control circuitry. A first group of the at least one first group comprises a first and a second LED connected in anti-parallel, and a second group of the at least one second group comprises a first and a second LED connected in anti-parallel. The at least one second group is connected in series with the at least one first group. The control circuitry is configured for selectively operating the first and second group in at least one first mode and at least one second mode. In the at least one first mode, the DC current is used to activate the first LED(s) of the at least one first group and/or of the at least one second group. In the at least one second mode, the DC current is used to activate the second LED(s) of the at least one first group and/or of the at least one second group.

By connecting first and second LEDs as described above, a selection of one or more first LEDs can be activated in a first mode, whilst the second LEDs are deactivated, and a selection of second LEDs can be activated in a second mode, whilst the first LEDs are deactivated, using a single regulated current driver and simple control circuitry. Also, the number of connection lines can be low, as the at least one first group and the at least one second group are connected in series. Indeed, there is a common node connecting the first group to the second group. Moreover, by using pairs of anti-parallel LEDs which are not activated together, the design can be compact.

Preferably, the at least one first mode and the at least one second mode are such that the regulated current driver always sees substantially the same load. Thus according to a first option, the control circuitry is configured for selectively operating the first and second group in at least one first mode and at least one second mode, wherein in the at least one first mode, the DC current is used to activate the first LED(s) of the at least
one first group or the at least one second group; and
in the at least one second mode, the DC current is used to activate the second LED(s) of the at
least one first group or the at least one second group.

Thus, in such an embodiment the load corresponds with first LED(s) of the first group or the first LED(s) of the second group or the second LED(s) of the first group or the second LED(s) of the second group. The amount of first LEDs and second LEDs in each group is thus preferably the same in such an embodiment. Such an embodiment is discussed in more detail in connection with FIGS. 1B and 3B.

According to a second option, the control circuitry is configured for selectively operating the first and second group in at least one first mode and at least one second mode, wherein in the at least one first mode, the DC current is used to activate the first LED(s) of the at least
one first group and the at least one second group; and
in the at least one second mode, the DC current is used to activate the second LED(s) of the at
least one first group and the at least one second group.

Thus, in such an embodiment the load corresponds with first LED(s) of the first group and the first LED(s) of the second group or with the second LED(s) of the first group and the second LED(s) of the second group. The total amount of first LEDs and the total amount of second LEDs is thus preferably the same in such an embodiment. Such an embodiment is discussed in more detail in connection with FIGS. 1A and 3A.

In embodiments of the invention, there is provided at least one first group and at least one second group. Preferably, there are provided at least two first groups, preferably at least three first groups, and/or at least two second groups, preferably at least three second groups. When multiple first groups are provided, the multiple first groups are preferably connected in series with each other. Similarly, when multiple second groups are provided, the multiple second groups are preferably connected in series with each other. Further, the multiple first groups may be the same or different, and the multiple second groups may be the same or different.

According to an exemplary embodiment, the light system further comprises a first optical element associated with the first and second LED of the first group and/or a second optical element associated with the first and second LED of the second group.

Since, the first and the second LED of a group will not be activated at the same time, and since they can be positioned relatively close to one another, a single optical element can be provided per group, further improving the compactness of the light system.

According to another exemplary embodiment, the light system further comprises a single optical element associated with the first and second LEDs of the first group and the second group.

The optical element may be any one of the following or a combination thereof: a lens, a reflector, a backlight, a prism, a collimator, a diffusor, and the like. Preferably, the optical element is a lens element. Also, an optical element may be combining multiple optical functions, e.g. a lens and a reflector function, or a collimator and a reflector function.

The first optical element may be the same or different from the second optical element. This will allow combining different optical functions in the same light system. For example, one or more groups (including a first and/or a second group) may be each provided with an optical element of a first type, and one or more other groups (including another first and/or second group) may be each provided with an optical element of a second type. This allows choosing a suitable optical element in function of the position of the LEDs in the light system. For example, LEDs near the periphery of a support structure may be provided with a different optical element compared to LEDs provided in the centre of the support structure, and/or LEDs near a luminaire pole may be provided with a different optical element compared to LEDs provided near a front end of a luminaire head. In yet another embodiment, the optical elements of the first and second type may be arranged alternately according to a regular pattern, for example according to a checkerboard pattern. Note that it is also possible to alternate one or more optical elements of the first type with one or more optical elements of the second type, e.g. 11221122 or 1221221, etc.

In the context of the invention, a lens element may include any transmissive optical element that focuses or disperses light by means of refraction. It may also include any one of the following: a reflective portion, a backlight portion, a prismatic portion, a collimator portion, a diffusor portion. For example, a lens element may have a lens portion with a concave or convex surface facing a light source, or more generally a lens portion with a flat or curved surface facing the light source, and optionally a collimator portion integrally formed with said lens portion, said collimator portion being configured for collimating light transmitted through said lens portion.

Also, a lens element may be provided with a reflective portion or surface or with a diffusive portion.

Preferably, the first and second LEDs of the at least one first and second group may be associated with an optical plate comprising the optical elements, for example a lens plate comprising the lens elements. For example, the lens plate may include the first and second optical element associated with the first and second group. Preferably, especially when multiple first and/or second groups are provided, the light system comprises an optical plate with a plurality of optical elements, preferably lens elements, wherein each first and/or second group is associated with an optical element of said optical plate. In other words, preferably, a single optical element of the optical plate is associated with a first and second LED of a first group, or with a first and second LED of a second group, or with two first and two second LEDs of a first and second group. Also, when multiple first and/or second groups are provided, it is possible to associate a single optical element of the optical plate with first and second LEDs of two or more adjacent first groups, or with first and second LEDs of two or more adjacent second groups.

According to an exemplary embodiment, the at least one first mode comprises at least two of the following:

- a common first mode wherein the first LEDs of the at least one first group and the at least one second group are activated;
- a first mode wherein the first LED(s) of the at least one first group is/are activated and the first LED(s) of the at least one second group is/are not activated;
- a further first mode wherein the first LED(s) of the at least one second group is/are activated and the first LED(s) of the at least one first group is/are not activated.

Using such different first modes, the number and/or position of the first LED(s) which is/are on can be varied. It is further noted that the first LEDs of the at least one first and second group may be the same or may be different. Thus, using such different modes, it will be possible to change the shape and/or position and/or color and/or light temperature and/or intensity of the light bundle emitted by the first LED(s).

In addition or alternatively, the at least one second mode may comprise at least two of the following:

- a common second mode wherein the second LEDs of the at least one first group and the at least one second group are activated;
- a second mode wherein the second LED(s) of the at least one first group is/are activated and the second LED(s) of the at least one second group is/are not activated;
- a further second mode wherein the second LED(s) of the at least one second group is/are activated and the second LED(s) of the at least one first group is/are not activated.

Similarly, using such different second modes, the number and/or position of the second LED(s) which is/are on can be varied. It is further noted that the second LEDs of the at least one first and second group may be the same or may be different. Thus, using such different modes, it will be possible to change the shape and/or position and/or color and/or light temperature and/or intensity of the light bundle emitted by the second LED(s).

According to an exemplary embodiment, the first and second LED of the first group each have a first terminal connected to a first common line portion, and/or the first and second LED of the second group each have a first terminal connected to a second common line portion. The first and second LED of the first group each have a second terminal which may be connected to a further common line portion in line with the first common line portion. Similarly, the first and second LED of the second group each have a second terminal which may be connected to a further common line portion in line with the second common line portion. Preferably, the first common line portion runs parallel to the second common line portion, and the first common line portion is connected to the second common line portion, preferably at an end portion thereof. When multiple first groups are connected in series, the first groups may be interconnected using a common line portion between two adjacent first groups, said common line portion being connected to the second terminals of the first and second LED of one of the two adjacent first groups and to first terminals of the first and second LED of the other one of the two adjacent first groups. The same applies when multiple second groups are connected in series.

The line portions may be provided in copper, and may be provided in or on a PCB. The line portions are flat portions extending in a plane of the PCB.

Since only one of the first and second LED of the first group has to be on at a time, the first and second LED of the first group may be connected to a common line portion. By using a common line portion, the line can be wider, resulting in improved heat exchange properties. In a similar manner, the first and second LED of the second group are connected to a second common line portion, which is arranged at a distance of the first line portion, preferably parallel to the first line portion. Optionally, multiple first groups may be interconnected using common line portions, such that those multiple first groups are connected in series. Similarly, multiple second groups may be interconnected using common line portions such that those multiple second groups are connected in series. Also, multiple parallel rows each including a plurality of first groups connected in series and interconnected using common line portions, and/or multiple parallel rows each including a plurality of second groups connected in series and interconnected using common line portions, may be provided. To connect the at least one first group in series with the at least one second group, the first line portion may be connected to the second line portion.

According to an exemplary embodiment, the control circuitry comprises at least a first branch with two switching elements connected in series, and a second branch with two switching elements connected in series, said first branch being connected in parallel with said second branch between a first current line for receiving the DC current from the driver and a second current line. A first intermediate node between the two switching elements of the first branch is connected to the first group and a second intermediate node between the two switching elements of the second branch is connected to the second group.

In that manner, by controlling the switching elements of the first and second branch, the first and second LEDs can be selectively switched on, in order to direct the DC current from the driver in a first or second direction through the at least one first group and/or through the at least one second group. Such control circuitry is simple and robust, and provides for an accurate selective driving of the first and second LEDs using the DC current from the driver.

Preferably, the control circuitry may be further configured for controlling the switching elements such that in a first common mode, the current from the driver flows from the first intermediate node through the first LEDs of the at least one first and second group to the second intermediate node, and such that in a second common mode, the current from the driver flows from the second intermediate node through the second LEDs of the at least one first and second group to the first intermediate node.

In that manner, using two branches with switching elements, two channels of LEDs, i.e. the first LED(s) of the at least one first and second group and the second LED(s) of the at least one first and second group, can be selectively switched on.

According to an exemplary embodiment, the control circuitry further comprises a third branch with two switching elements connected in series, said third branch being arranged in parallel with the first and second branch, wherein a third intermediate node between the two switching elements of the third branch is connected to an intermediate node between the at least one first group and the at least one second group.

Preferably, the control circuitry is then further configured such that in a first mode, the current from the driver flows from the first intermediate node through the first LED(s) of the at least one first group to the third intermediate node, and such that in a second mode, the current from the driver flows from the third intermediate node through the second LED(s) of the at least one first group to the first intermediate node; and/or such that in a further first mode, the current from the driver flows from the second intermediate node through the first LED(s) of the at least one second group to the third intermediate node, and such that in a further second mode, the current from the driver flows from the third intermediate node through the second LED(s) of the at least one second group to the second intermediate node.

In that manner, using only three branches with switching elements, four channels of LEDs, i.e. the first LED(s) of the at least one first group, the first LED(s) of the at least one second group, the second LED(s) of the at least one first group, and the second LED(s) of the at least one second group, can be selectively switched on.

The switching elements may be any suitable switching elements, preferably transistors, more preferably MOSFET transistors.

According to an exemplary embodiment, the control circuitry is configured to receive a desired light pattern as an input, to select a control scheme out of a plurality of different stored control schemes in accordance with the desired light pattern, and to control the control circuitry, and in particular the switching elements, in accordance with the selected control scheme.

For example, when multiple different modes are available as explained above, a control scheme may consist in using one of those modes, or in using alternately two or more of said modes. Also, a control scheme may prescribe to use two or more modes according to a particular time scheme.

According to another exemplary embodiment, the control circuitry is configured to receive a control parameter as an input, e.g. a value measured by a sensor, to select a control scheme out of a plurality of different stored control schemes in accordance with the input, and to control the control circuitry, and in particular the switching elements, in accordance with the selected control scheme.

In that manner a control scheme may be selected in function of an input, e.g. a measured value by a sensor or a command received from a remote system. For example, the control scheme may be adjusted in function of an input indicative for motion detected by a motion sensor, and/or in function of an input indicative of a light level sensed by a light sensor, etc.

According to another exemplary embodiment, the driver comprises dimming circuitry configured to change the DC current in function of a dimming input. The DC current is a regulated DC current.

The first LED and the second LED may be the same or different. Also, the first LED of the first group may be the same as or different from the first LED of the second group. Also, the second LED of the first group may be the same as or different from the second LED of the second group.

The first and second LEDs may be any one of the following: a red LED, a green LED, a blue LED, a white LED, a warm white LED, a cool white LED, an amber LED, etc. Optionally the LEDs may comprise a phosphor coating.

According to another exemplary embodiment, the first LED and the second LED have substantially the same forward biasing voltage. The first LED may have a phosphor coating which is the same as or different from a phosphor coating of the second LED. Also, some first and/or second LEDs may have a phosphor coating and other first and/or second LEDs may not have a phosphor coating.

The skilled person understands that the first and second LEDs of the at least one first and second group may be arranged in any suitable manner on a support, typically a PCB. Optionally, the first and second LEDs of the at least one first and second group may be arranged in an array comprising at least two rows and at least two columns. Preferably, when multiple first and second groups are provided, also the groups are arranged in an array comprising at least two rows and at least two columns. The distance between a first and a second LED within a same group may be different from the distance between two adjacent first LEDs from different groups.

By choosing an appropriate position for the LEDs in the array on the PCB a different light output can be achieved with different control schemes as described above. A different light output may refer to a different light pattern on the ground, a different color, a different color temperature, a different intensity, a different flashing pattern, etc.

In a preferred embodiment, the or each first group consists of a single first LED and a single second LED, and/or the or each second group consists of a single first LED and a single second LED.

According to another exemplary embodiment, the first group comprises a plurality of first LEDs connected in anti-parallel with one or more second LED(s); and/or the second group comprises a plurality of first LEDs connected in anti-parallel with one or more second LED(s). In other words, instead of providing one first LED and one second LED in a group, it is also possible to include a first string with multiple first LEDs and/or a second string with multiple second LEDs in a group, wherein the first string is connected in anti-parallel with the second string. It is also possible to include a dummy component in the first and/or second string in order to compensate for a difference between the sum of the forward voltages of the LEDs in the first string and the sum of the forward voltages of the LEDs in the second string.

Preferably, the sum of the forward voltages of the first LEDs of the at least one first group is substantially the same as the sum of the forward voltages of the second LEDs of the at least one first group, and as the sum of the forward voltages of the first LEDs of the at least one second group, and as the sum of the forward voltages of the second LEDs of the at least one second group.

According to an exemplary embodiment, the control circuitry is configured for switching between a first mode of the at least one first mode and a second mode of the at least one second mode, such that the DC current provided by the driver before, during, and after the switching, is within 30% of a nominal value, preferably within 20% of a nominal value, more preferably within 10% of a nominal value. The control circuitry may be configured for reducing any driver current flicker or ripple.

The control circuitry may be configured for receiving the DC drive current, i.e. a regulated DC current, from the driver, and for directing the DC current through a first and/or second group of the at least one first and second group without dimming, in accordance with a first or second mode of the at least one first and second mode. A light system of the invention can be used with any standard driver, and optionally dimming functionalities may be included in the driver. Typically, no dimming functionalities are included in the control circuitry.

According to another exemplary embodiment, the control circuitry comprises any one or more of the following: a field programmable gate array, an ASIC, a microcontroller, control switches.

According to another exemplary embodiment, the driver is further configured to deliver an auxiliary supply voltage for the control circuitry. In that manner the need for an external power supply for the control circuitry is avoided, resulting in a more compact system.

According to another aspect of the invention, there is provided a luminaire, in particular an outdoor luminaire, comprising a light system according to any one of the previous embodiments. Preferably, the luminaire comprises a luminaire head with a luminaire housing and the first and second LEDs are arranged on a PCB in the luminaire housing. The driver may be arranged on or in the luminaire housing, or in any other suitable location of the luminaire Preferably, the control circuitry is provided on a PCB in the luminaire housing.

The light system according to any one of the embodiments above is preferably for use in an outdoor luminaire. By outdoor luminaires, it is meant luminaires which are installed on roads, tunnels, industrial plants, stadiums, airports, harbours, rail stations, campuses, parks, cycle paths, pedestrian paths or in pedestrian zones, for example, and which can be used notably for the lighting of an outdoor area, such as roads and residential areas in the public domain, private parking areas and access roads to private building infrastructures, etc.

BRIEF DESCRIPTION OF THE FIGURES

The accompanying drawings are used to illustrate presently preferred non-limiting exemplary embodiments of light systems of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1A:
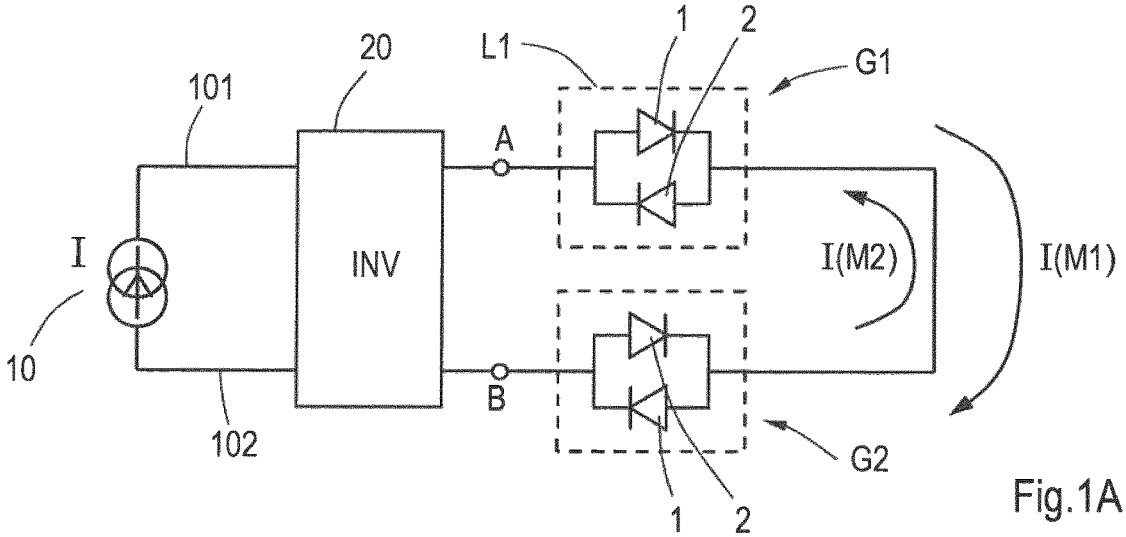
FIGS. 1A and 1B are circuit diagrams of two exemplary embodiments of a light system.

FIG. 1A illustrates a first exemplary embodiment of a light system. The light system comprises a driver 10 configured to generate a DC current I, a control circuitry 20, a first group G1 of LEDs 1, 2 and a second group G2 of LEDs 1, 2. The first group G1 comprises a first LED 1 and a second LED 2 connected in anti-parallel, and the second group G2 comprises a first LED 1 and a second LED 2 connected in anti-parallel. The second group G2 is connected in series with the first group G1. The control circuitry 20 is inserted between the driver 10 and the LEDs 1, 2 and is configured for selectively operating the LEDs 1, 2 of the first and second group G1, G2 in a first mode M1 and a second mode M2. The control circuitry 20 has two outputs A, B, and the current I is sent either from A to B (first mode M1) or from B to A (second mode M2).

In the first mode M1, the DC current I is used to activate the first LEDs 1 of the first group G1 and the second group G2, whilst the second LEDs 2 are off. In the second mode M2, the DC current I is used to activate the second LEDs 2 of the first group G1 and the second group G2, whilst the first LEDs 1 are off. In other words, depending on the mode M1, M2, either the first LEDs 1 or the second LEDs 2 are switched on.

Figure 1B:
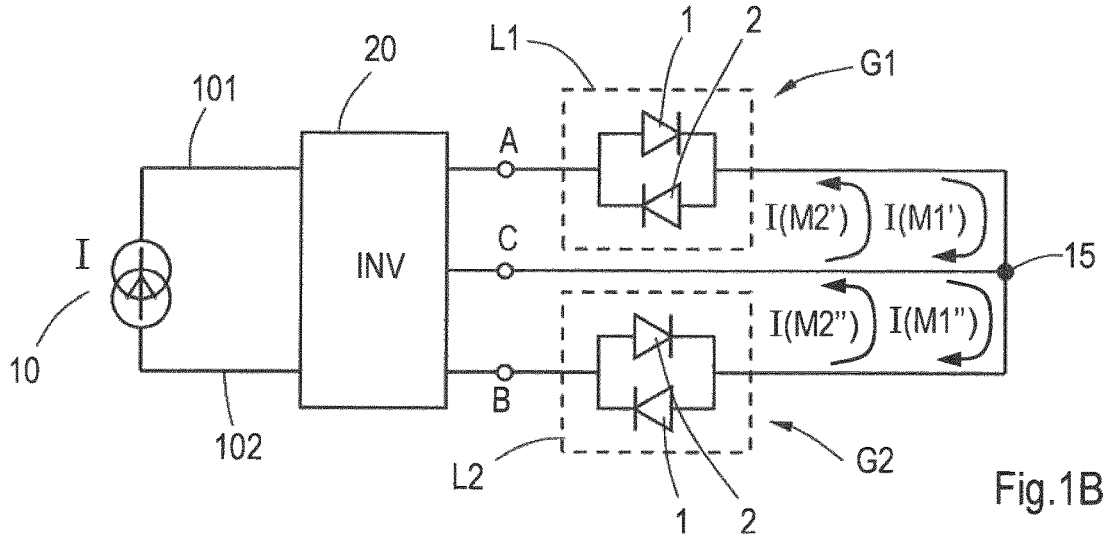

FIG. 1B illustrates a second exemplary embodiment of a light system. The light system comprises a driver 10 configured to generate a DC current I, a control circuitry 20, a first group G1 of LEDs 1, 2 and a second group G2 of LEDs 1, 2. The DC current is a regulated DC current. The first group G1 comprises a first LED 1 and a second LED 2 connected in anti-parallel, and the second group G2 comprises a first LED 1 and a second LED 2 connected in anti-parallel. The second group G2 is connected in series with the first group G1. The control circuitry 20 is inserted between the driver 10 and the LEDs 1, 2 and is configured for selectively operating the first and second group G1, G2 in a plurality of first modes M1', M1' and in a plurality of second modes M2', M2". The control circuitry 20 has three outputs A, B, C. The first output A is connected to the first group, the second output B is connected to the second group and the third output C is connected to an intermediate node 15 between the first and the second group. The control circuitry 20 is configured such that the current I is sent either from A to C (first mode M1') or from C to A (second mode M2'), or from C to B (first mode M1"), or from B to C (second mode M2").

In the first mode M1', the DC current I is used to activate the first LED 1 of the first group G1, whilst all other LEDs 1, 2 are off. In the second mode M2', the DC current I is used to activate the second LED 2 of the first group G1, whilst all other LEDs 1, 2 are off. In the other first mode M1", the DC current I is used to activate the first LED 1 of the second group G2, whilst all other LEDs 1, 2 are off. In the other second mode M2", the DC current I is used to activate the second LED 2 of the second group G2, whilst all other LEDs 1, 2 are off. In other words, depending on the mode M1', M1", M2', M2", any one of the LEDs 1, 2 can be switched on, whilst the other LEDs 1, 2 are switched off. Thus, using three control channels A, B, C, four LEDs 1, 2 can be individually controlled. Thus, in such an embodiment, the load seen by the driver 10 is substantially constant and consists in this example of one LED 1 or 2.

In the embodiments of FIGS. 1A and 1B there is provided a first optical element L1, preferably a lens element, associated with the first and second LED 1, 2 of the first group G1 and a second optical element L2 associated with the first and second LED 1, 2 of the second group G2. In other embodiments an optical element may be associated with only one LED or with more than two LEDs, see also FIGS. 4A and 4B. Preferably, the optical elements L1, L2 are integrated in a single optical plate. For example, the optical elements L1, L2 may be free-form lens elements integrated in a lens plate.

Figure 2:
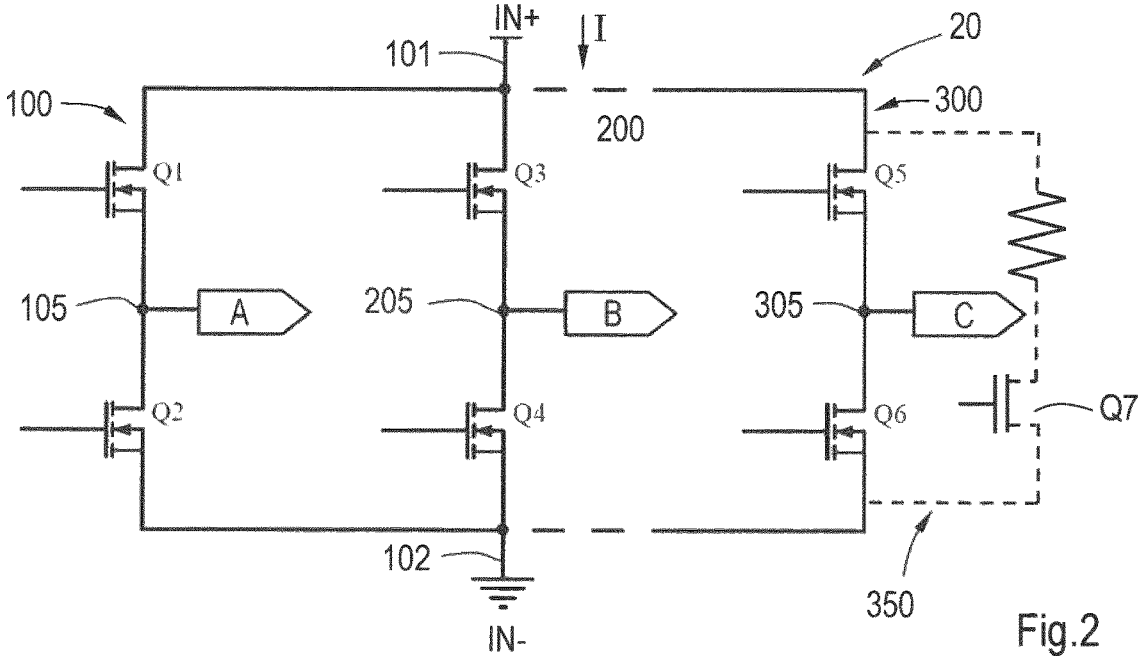
FIG. 2 is a circuit diagram of an exemplary embodiment of an invertor for use in a light system.

FIG. 2 illustrates an exemplary embodiment of control circuitry 20. The control circuitry 20 comprises a first branch 100 with two switching elements Q1, Q2, here MOSFETs, connected in series, a second branch 200 with two switching elements Q3, Q4 connected in series, and a third branch 300 with two switching elements Q5, Q6 connected in series. When the control circuitry 20 of FIG. 2 is used to implement the embodiment of FIG. 1A, the third branch 300 may be omitted. The first branch 100 is connected in parallel with the second branch 200 and with the third branch 300, between a first current line 101 for receiving the DC current from the driver 10 and a second current line 102, see also FIGS. 1A and 1B. Optionally, a further branch 350 may be provided which can be activated during switching of any one of the switches Q1-Q6, in order to reduce or avoid discontinuities of the current provided by the driver 10. In the illustrated example the further branch 350 comprises a resistor and a MOSFET Q7, but many other implementations are possible.

Preferably, the control circuitry 20 is further configured for switching between a first mode of the at least one first mode and a second mode of the at least one second mode, such that the DC current I provided by the driver before, during, and after the switching, is within 30% of a nominal value, preferably within 20% of a nominal value, more preferably within 10% of a nominal value. This may be achieved by appropriately controlling the switches Q1-Q6 and optionally by adding filter elements and/or cross conduction elements such as the optional branch 350 in order to reduce any current ripple and/or flicker. More generally, any solution known to the skilled person to achieve this goal may be used. The control circuitry 20 is configured for receiving the DC drive current I from the driver, and for directing the DC current through the at least one first and/or second group, without dimming, in accordance with a first or second mode of the at least one first and second mode, by switching the switches Q1-Q6. It is noted that in this embodiment the control circuitry 20 does not perform dimming. However, dimming may be implemented in the driver 10. Embodiments of the invention may be performed with any standard driver 10 and optionally the driver 10 may include dimming functionalities.

Figure 3A:
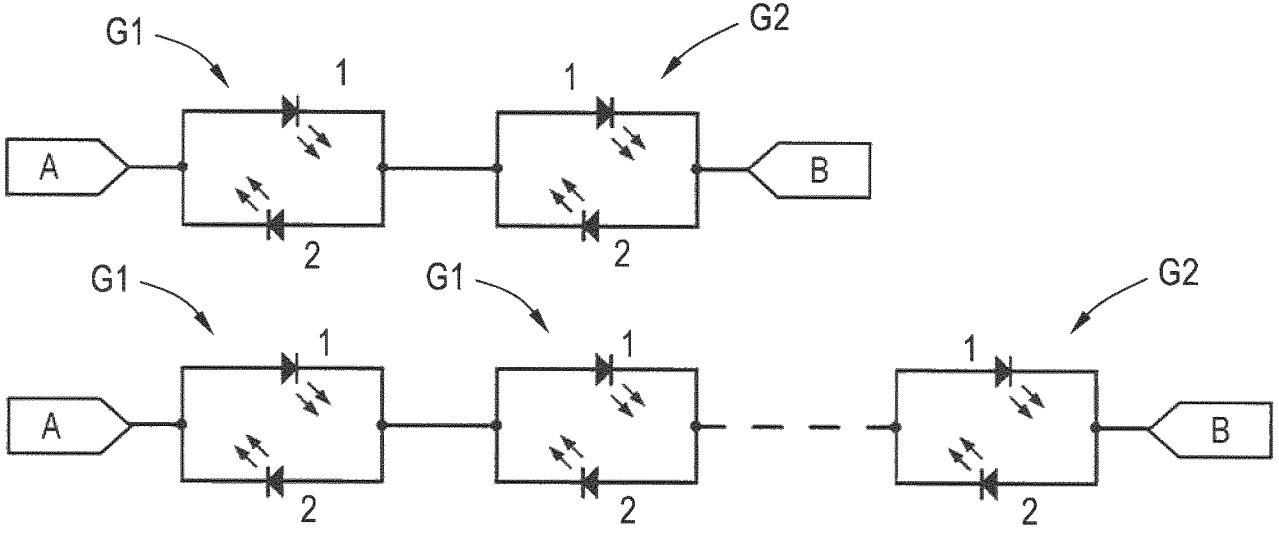
FIG. 3A shows circuit diagrams and a table illustrating the operation of a first exemplary embodiment with a single first and second group, and of a second exemplary embodiment with multiple first and second groups, of a light system which is similar to FIG. 1A.

FIG. 3A illustrates the operation of a first exemplary embodiment which is similar to the embodiment of FIG. 1A, using the control circuitry of FIG. 2. A first intermediate node 105 between the two switching elements Q1, Q2 of the first branch 100 is connected (see the indication A in FIG. 2 and in FIG. 3A) to the first group G1 and a second intermediate node 205 between the two switching elements Q3, Q4 of the second branch is connected (see the indication B in FIG. 2 and FIG. 3A) to the second group G2.

The control circuitry 20 is further configured for controlling the switching elements Q1, Q2, Q3, Q4 such that in a first common mode M1, the current I from the driver 10 flows from the first intermediate node 105 through the first LEDs 1 of the at least one first and second group G1, G2 to the second intermediate node 205, i.e. the current flows from A to B in mode M1. This is achieved by switching on Q1 and Q4 and by switching off Q2 and Q3, as shown in the table of FIG. 3A. The control circuitry 20 is further configured for controlling the switching elements Q1, Q2, Q3, Q4 such that in a second common mode M2, the current I from the driver 10 flows from the second intermediate node 205 through the second LEDs 2 of the at least one first and second group G1, G2 to the first intermediate node 105, i.e. the current flows from B to A in mode M2. This is achieved by switching off Q1 and Q4 and by switching on Q2 and Q3, as shown in the table of FIG. 3A.

As illustrated in the two circuit diagrams of FIG. 3A, either a single first and second group G1, G2 may be present, or multiple first and/or second groups G1, G2 may be present. It is noted that in the embodiment of FIG. 3A, the groups G1, G2 may be identical and may all be indicated with reference letter G instead of making a distinction between G1 and G2.

Figure 3B:
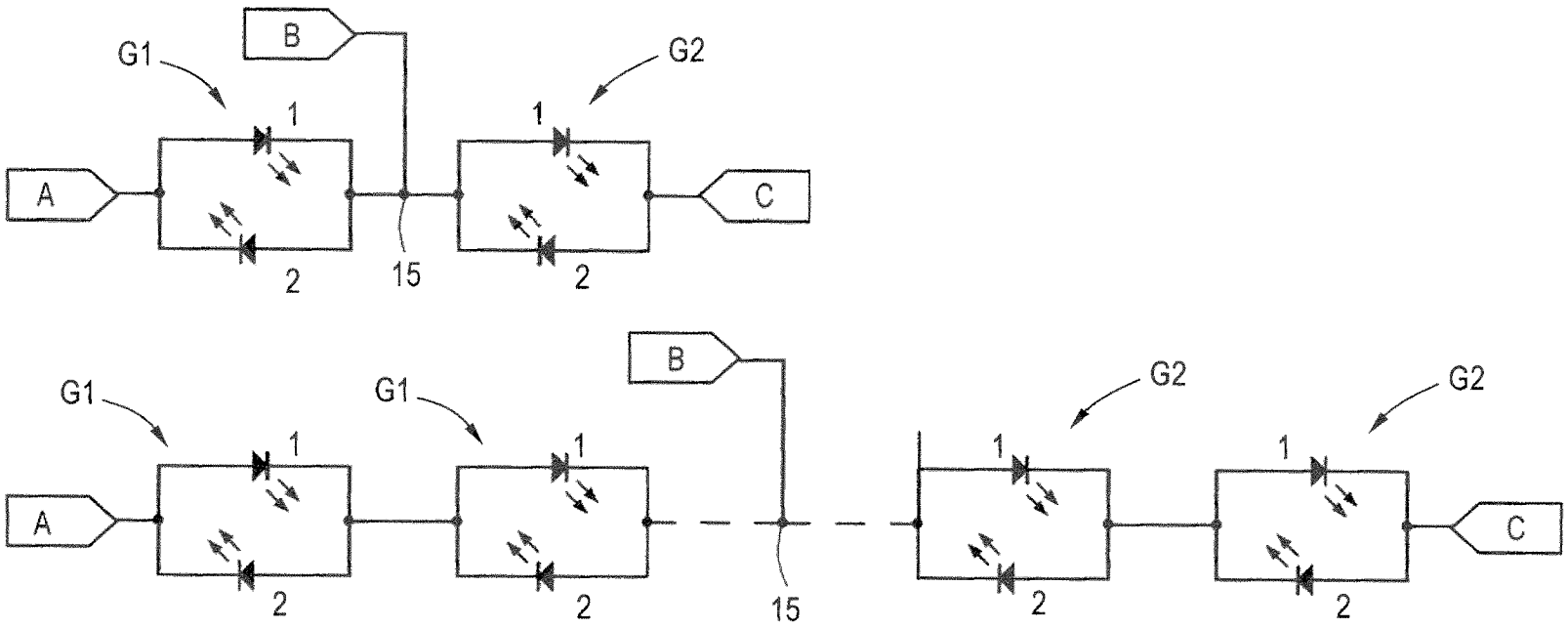
FIG. 3B shows circuit diagrams and a table illustrating the operation of a first exemplary embodiment with a single first and second group, and a second exemplary embodiment with multiple first and second groups, of a light system which is similar to FIG. 1B.

FIG. 3B illustrates the operation of a second exemplary embodiment which is similar to the embodiment of FIG. 1B, using the control circuitry of FIG. 2. A first intermediate node 105 between the two switching elements Q1, Q2 of the first branch 100 is connected (see the indication A in FIG. 2 and in FIG. 3B) to the first group G1 and a third intermediate node 305 between the two switching elements Q5, Q6 of the third branch 300 is connected (see the indication C in FIG. 2 and in FIG. 3B) to the second group G2. The second intermediate node 205 between the two switching elements Q3, Q4 of the second branch 200 is connected (see the indication B in FIG. 2 and in FIG. 3B) to an intermediate node 15 between the at least one first group G1 and the at least one second group G2.

The control circuitry 20 is further configured for controlling the switching elements Q1, Q2, Q3, Q4, Q5, Q6 such that in a first common mode M1', the current I from the driver 10 flows from the first intermediate node 105 through the first LEDs 1 of the at least one first group G1 to the second intermediate node 205, i.e. the current flows from A to B in mode M1'. This is achieved by switching on Q1, Q4 and Q6 and by switching off Q2, Q3 and Q5, as shown in the table of FIG. 3B. The control circuitry 20 is further configured for controlling the switching elements Q1, Q2, Q3, Q4, Q5, Q6 such that such that in a second common mode M2', the current I from the driver 10 flows from the second intermediate node 205 through the second LEDs 2 of the at least one first group G1 to the first intermediate node 105, i.e. the current flows from B to A in mode M2'. This is achieved by switching off Q1, Q4 and Q6 and by switching on Q2, Q3 and Q5, as shown in the table of FIG. 3B. The control circuitry 20 is further configured such that in a further first mode M1", the current I from the driver 10 flows from the second intermediate node 205 through the first LED(s) 1 of the at least one second group G2 to the third intermediate node 305, i.e. from B to C, and such that in a further second mode M2", the current I from the driver 10 flows from the third intermediate node 305 through the second LED(s) 2 of the at least one second group G2 to the second intermediate node 205, i.e. from C to B.

As illustrated in the two circuit diagrams of FIG. 3B, either a single first and second group G1, G2 may be present, or multiple first and/or second groups G1, G2 may be present.

Figure 4A:
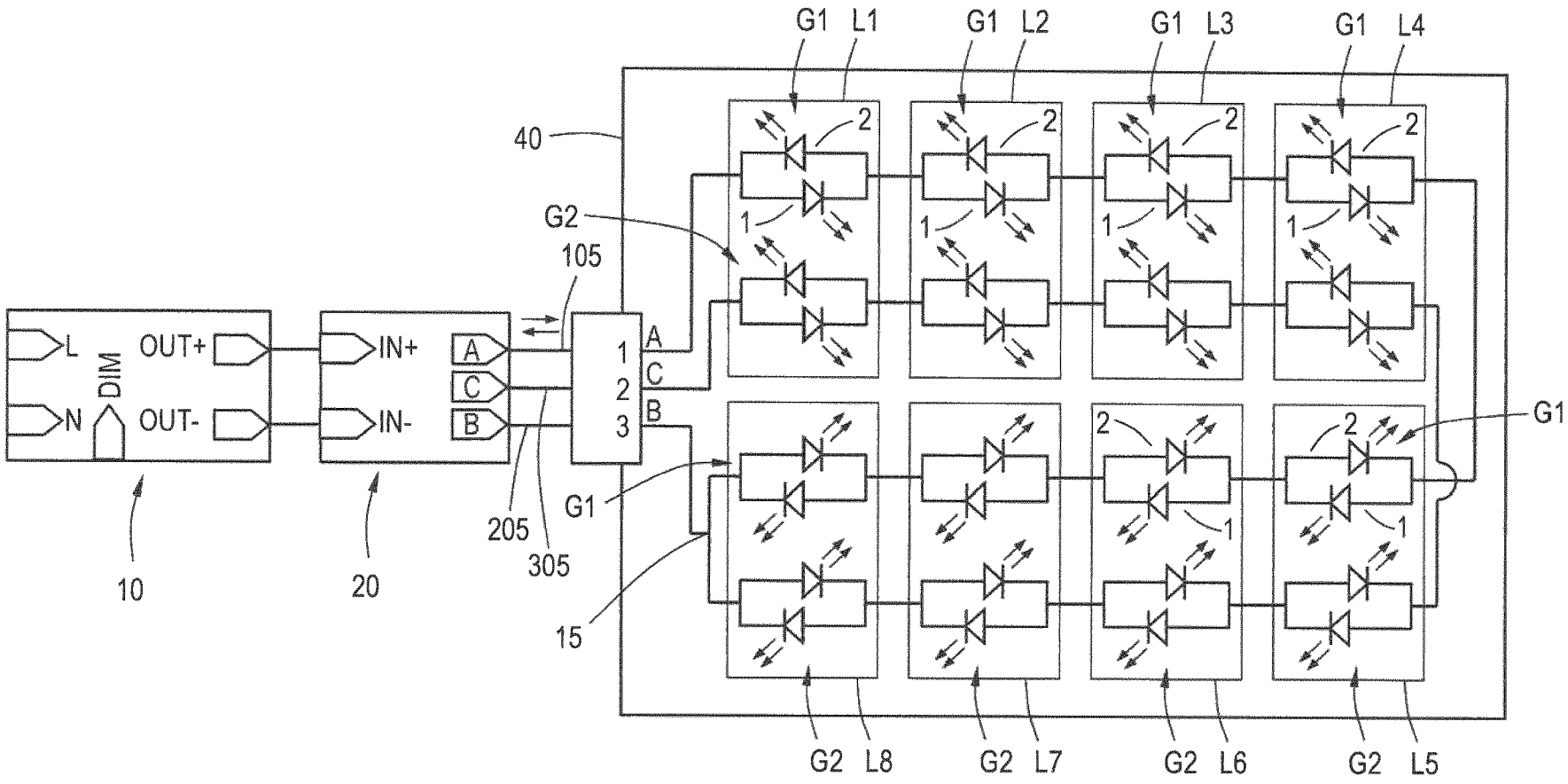
FIGS. 4A, 4B and 4C are circuit diagrams of three exemplary embodiments of a light system illustrating how the groups may be arranged on one or more PCBs.
Figure 4B:
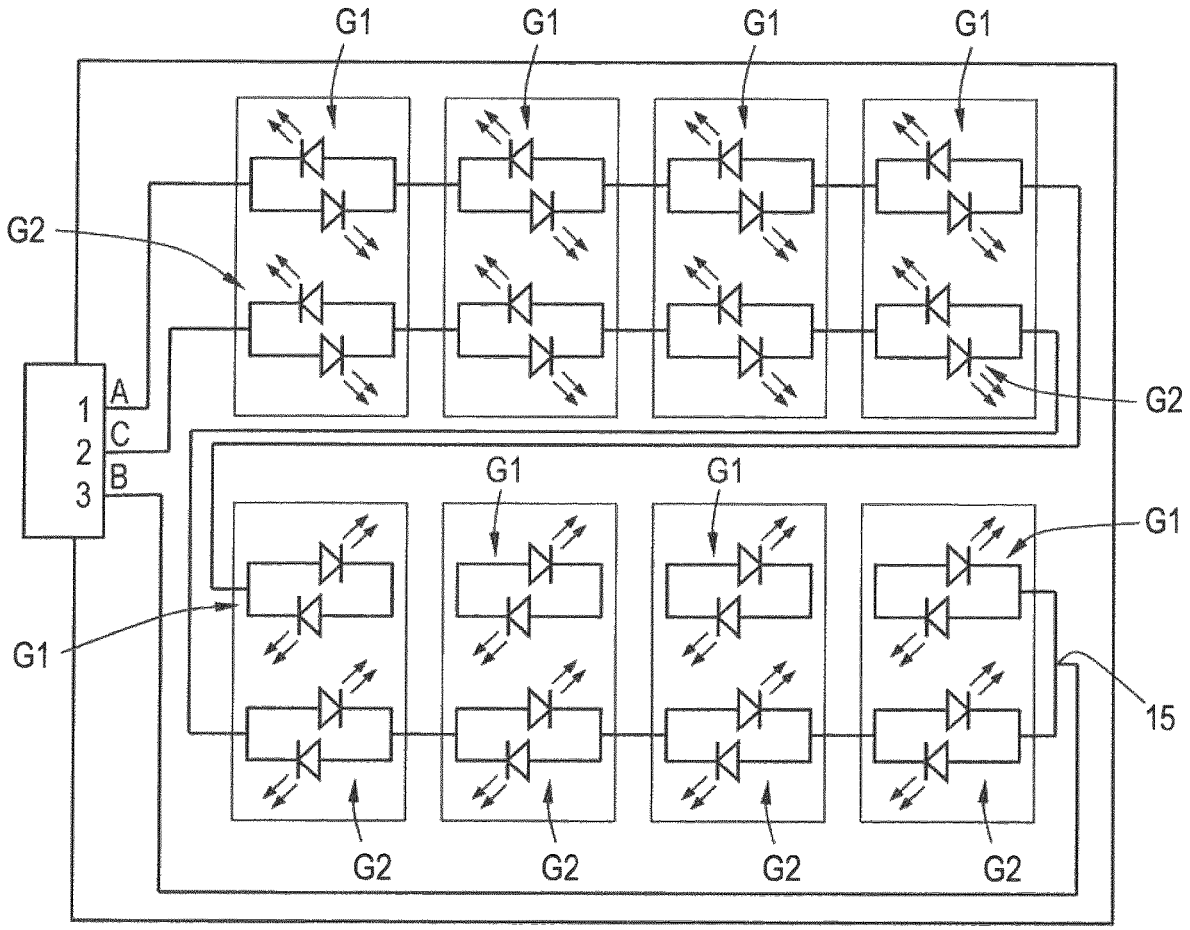

FIGS. 4A and 4B illustrate two further exemplary embodiments, which operate along the same principles as the embodiment of FIGS. 1B and 3B, and wherein the same components have been indicated with the same reference numerals. In the embodiment of FIG. 4A, a string of eight first groups G1 is connected in series with a string of eight second groups G2. A first end of the string of first groups G1 is connected to an output A of the control circuitry 20, and a second end of the string of first groups G1 is connected to the string of second groups G2. Similarly, a first end of the string of second groups G2 is connected to an output C of the control circuitry 20, and a second end of the string of second groups G2 is connected to the second end of the string of first groups G1. An intermediate node 15 between the first and second string is connected to an output B of the control circuitry. This is similar to the embodiment of FIG. 3B. The groups G1, G2 may be arranged as an array on a support 40, typically a PCB. In the illustrated embodiment the groups G1, G2 are arranged according a 4×4 array. The first row comprises four first groups G1, the second row four second groups G2, etc. Further, there is provided a single optical element L1, L2, L3, L4, L5, L6, L7, L8, e.g. a lens element, for a pair of an adjacent first and second group G1, G2. The optical elements L1, L2, L3, L4, L5, L6, L7, L8 may be part of one integral optical plate. For example, the optical elements L1, L2, L3, L4, L5, L6, L7, L8 may be free-form lens elements integrated in a lens plate. In the embodiment of FIG. 4A, the connection between the rows implements a bridge for connecting the second row of four second groups G2 with the fourth row of four second groups G2. However, as illustrated in FIG. 4B, it is also possible to design the connection lines such that no bridge is needed. Preferred embodiments of the invention can be implemented on a PCB with a single conductive layer either without bridges or with one or more bridges (using e.g. a jumper to implement a bridge) or on a PCB with two conductive layers.

In the embodiments of FIGS. 4A and 4B the four LEDs which are arranged under a single lens L1, L2, L3, L4, L5, L6, L7, L8 may be four individual LED components or a single LED component including four LEDs.

Figure 4C:
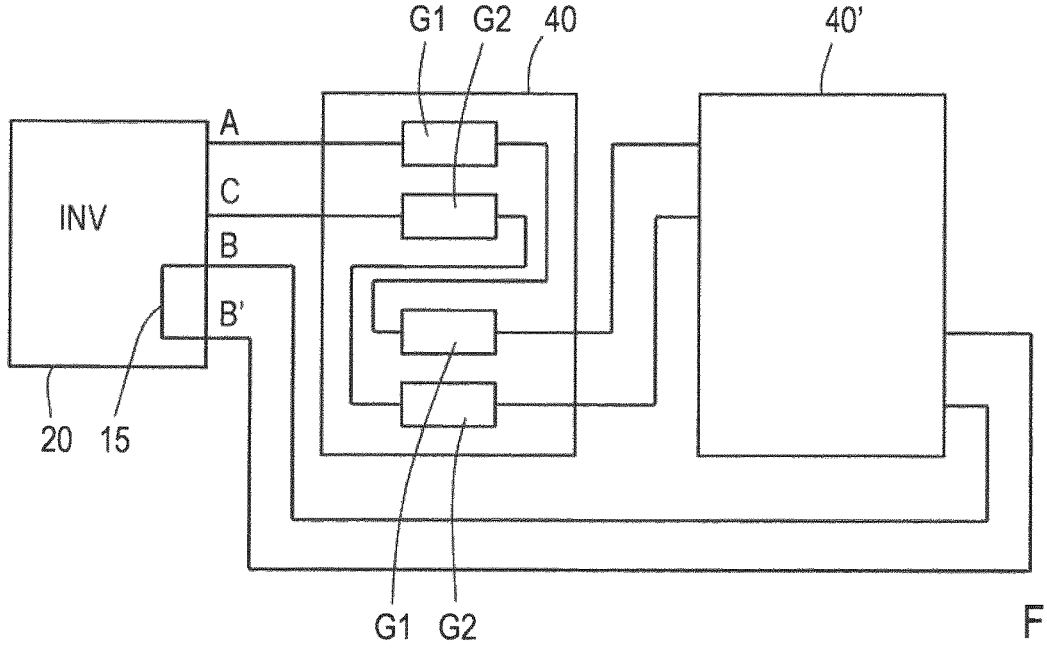

FIG. 4C illustrates a variant of the embodiment of FIG. 4B where multiple PCB's 40, 40' are connected in series to form a string of a plurality of first groups G1 connected in series with a string of a plurality of second groups G2. The PCB's 40, 40' may be the same, and may be designed in a modular manner as shown, such that the first groups G1 of PCB 40 can be connected in series with first groups G1 of PCB 40', and the second groups G2 of PCB 40 can be connected in series with the second groups of PCB 40'. A first end of the string of first groups G1 is connected to an output A of the control circuitry 20. Similarly, a first end of the string of second groups G2 is connected to an output C of the control circuitry 20. Instead of providing the intermediate node 15 on the PCB as in the embodiments of FIGS. 4A and 4B, the intermediate node 15 may be provided in or at the inverter 20 by connecting outputs B and B' as shown in FIG. 4C.

The control circuitry 20 may control the LEDs 1, 2 according to different modes. The modes may comprise at least one first mode and at least one second mode. The at least one first mode may comprise:

- a first mode (M1') wherein the first LEDs 1 of the first groups G1 is/are activated and the first LEDs 1 of the second groups G2 is/are not activated;
- a further first mode (M1") wherein the first LEDs 1 of the second groups G2 is/are activated and the first LEDs 1 of the first groups G1 is/are not activated.

Similarly, the at least one second mode may comprise:

- a second mode M2', wherein the second LEDs 2 of the first groups G1 is/are activated and the second LEDs 2 of the second groups G2 are not activated;
- a further second mode M2", wherein the second LEDs 2 of the second groups G2 is/are activated and the second LEDs 2 of the first groups G1 is/are not activated.

Figure 5A:
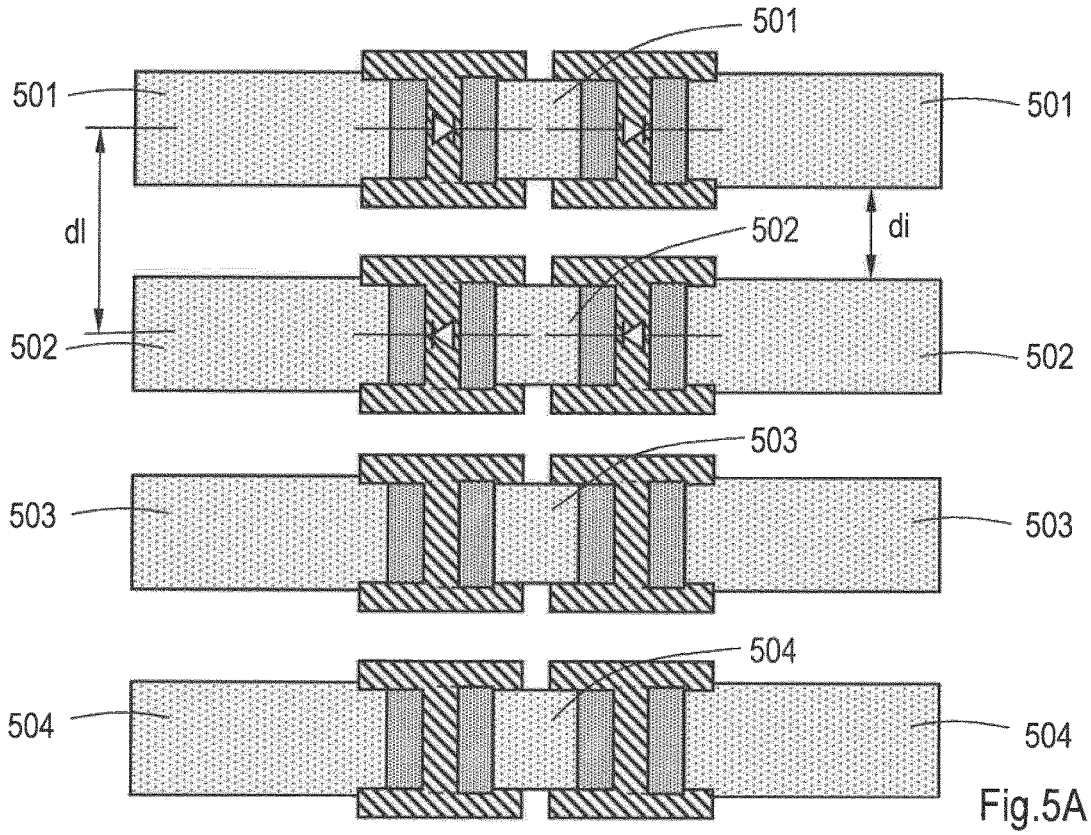
Fig.5A (PRIOR ART)
FIG. 5A shows a top view of a portion of a PCB with LED circuitry according to the prior art.
Figure 5B:
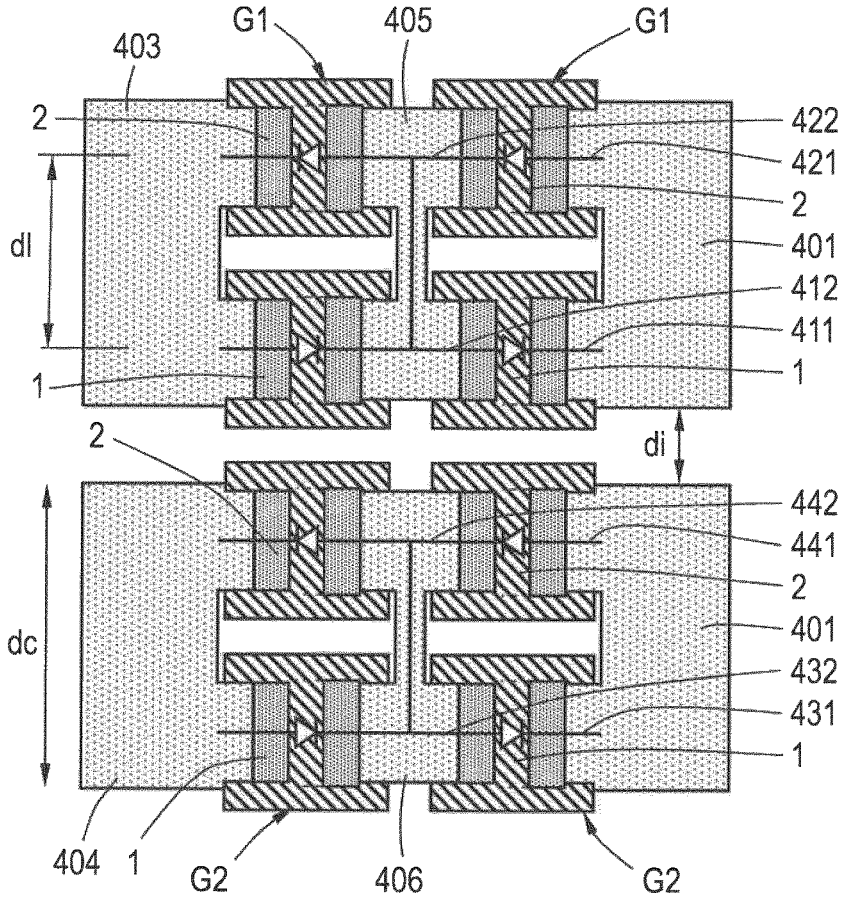
FIG. 5B shows a top view of a portion of a PCB on which two first and two second groups are arranged in accordance with an exemplary embodiment.

FIG. 5B illustrates that the first and second LED 1, 2 of a first group G1 may be connected with its first terminals 411, 421 to a first common line portion 401 on a PCB 40, and that the first and second LED 1, 2 of the second group G2 may be connected with its first terminals 431, 441 to a second common line portion 402. The first common line portion 401 runs parallel to the second common line portion 402. The first common line portion 401 may be connected to the second common line portion 402 at an end portion thereof (not shown). The first and second LED of the first group G1 each have a second terminal 412, 422 which may be connected to a further common line portion 405 in line with the first common line portion 401. Similarly, the first and second LED of the second group G2 each have a second terminal 432, 442 which may be connected to a further common line portion 406 in line with the second common line portion 402. When multiple first groups G1 are connected in series, as shown, the first groups may be interconnected using the common line portion 405 between two adjacent first groups G1. The common line portion 405 is connected to the second terminals 412, 422 of the first and second LED of one (here the first group on the right) of the two adjacent first groups G1 and to first terminals of the first and second LED of the other one (here the first group on the left) of the two adjacent first groups. The same applies for the second groups G2. At the other end of a row, in a similar manner, common line portions 403, 404 may be connected to terminals of a first and second LED of a first group G1 and to terminals of a first and second LED of a second group G2, respectively, see the groups G1 and G2 on the left of FIG. 5B. In that manner, first and second LEDs 1, 2 of a group can be arranged close to each other.

The width dc of a common line portion 401, 402, 403, 404, 405, 406 may be e.g. between 0.5 and 20 mm Preferably, the distance di between two parallel common lines portions 401, 402 may be smaller than 20 mm, e.g. between 0.2 and 5 mm Preferably, the distance dl between the centers of adjacent LEDs 1, 2 of a first or second group G1, G2 may be between 0.1 mm and 5 mm, e.g. between 0.1 mm and 1 mm. The line portions 401, 402, 403, 404, 405, 406 may be provided in copper, and may be provided in or on a PCB. The line portions 401, 402, 403, 404, 405, 406 are flat portions extending in a plane of the PCB. The PCB may be a metal core PCB (MCPCB) with only one copper layer.

A typical prior art implementation is shown in FIG. 5A for comparison. In the illustrated prior art solution four rows of LEDs connected in series are arranged on a PCB. A first series connection of LEDs is provided in a first row comprising first line portions 501, a second series connection of LEDs is provided in a second row comprising second line portions 502, etc. The distance dl between a LED included in the first row with first line portions 501 and an adjacent LED included in the second row with second line portions 502, will have to be bigger than the corresponding distance dl in an embodiment of the invention, as shown in FIG. 5B. This is because a minimum distance di has to be present between line portions 501 and 502. It is noted that FIGS. 5A and 5B are not drawn to scale.

Figure 5C:
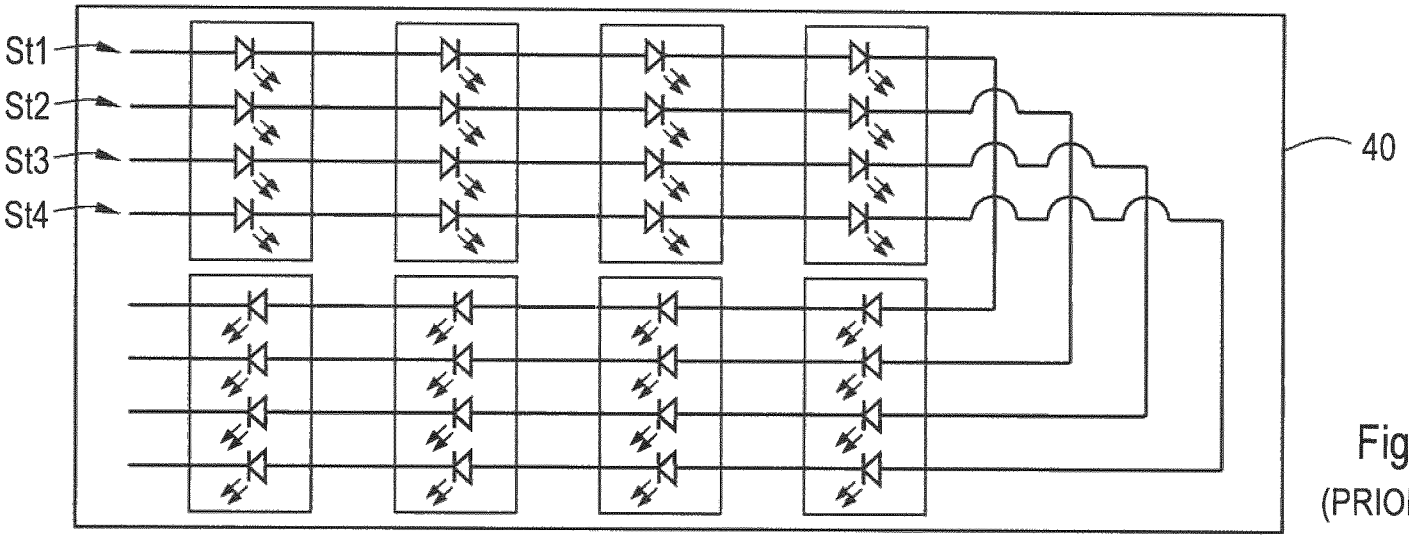
Fig.5C (PRIOR ART)
FIGS. 5C and 5D are a circuit diagrams of prior art circuits arranged on a PCB.
Figure 5D:
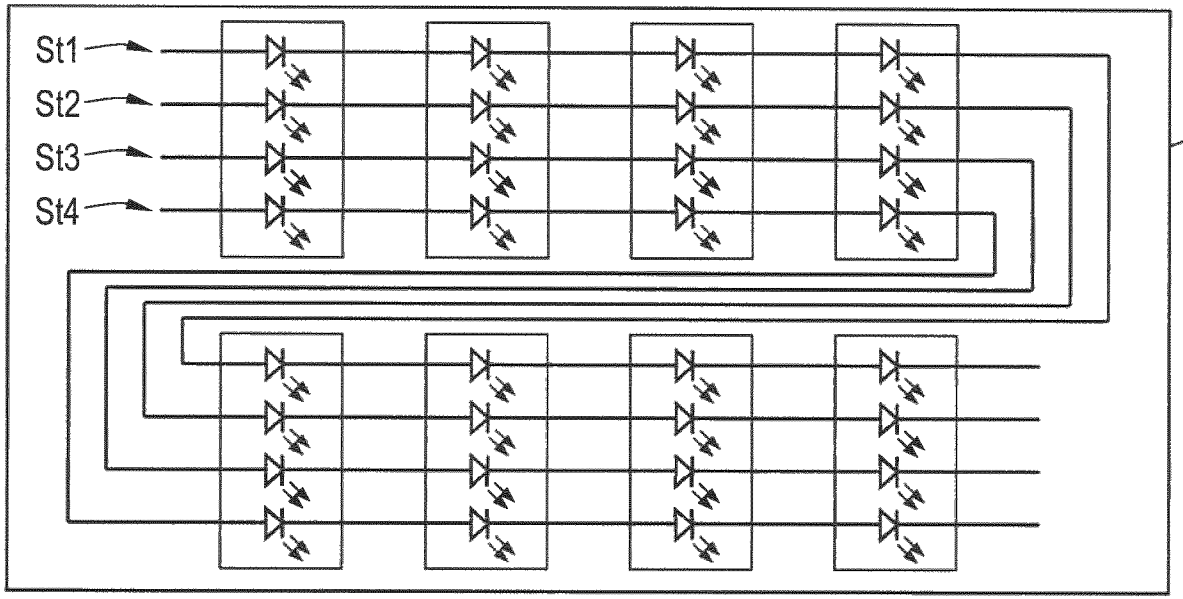
Fig.5D (PRIOR ART)

In order to illustrate the advantages of embodiments of the invention, FIGS. 5C and 5D illustrate two prior art circuits with a plurality of LED strings St1, St2, St3, St4. Each LED strings St1, St2, St3, St4 comprises a plurality of LEDs connected in series. In total 4×8 LEDs are arranged on a PCB 40. Each LED strings St1, St2, St3, St4 comprises eight LEDs, and each LED string can be individually activated. In the embodiment of FIG. 5C four connection lines and six bridges are used for the connecting of the 32 LEDs. Also, in the circuit of FIG. 5D four connection lines are needed. When comparing the prior art circuits of FIGS. 5C and 5D with the embodiment of FIGS. 4A and 4B, it can be seen that, for the same amount of LEDs, the amount of connection lines in embodiments of the invention is significantly reduced as compared with prior art circuits. Further, when comparing the prior art circuit of FIG. 5C with the embodiment of FIG. 4A, it can be seen that embodiments of the invention allow reducing the number of bridges: one bridge in the embodiment of FIG. 4A versus six bridges in the prior art circuit of FIG. 5C. Also, when comparing the prior art circuit of FIG. 5D with the embodiment of FIG. 4B, it can be seen that embodiments of the invention allow reducing the number of connection lines returning from one side to the other side of the PCB 40 (here from right to left): two lines in the embodiment of FIG. 4B versus four lines in the prior art circuit of FIG. 5D.

In FIG. 5B the LEDs 1, 2 are arranged in a matrix:

| | |
|---|---|
| 2 | 2 |
| 1 | 1 |
| 2 | 2 |
| 1 | 1 |

Figure 6:
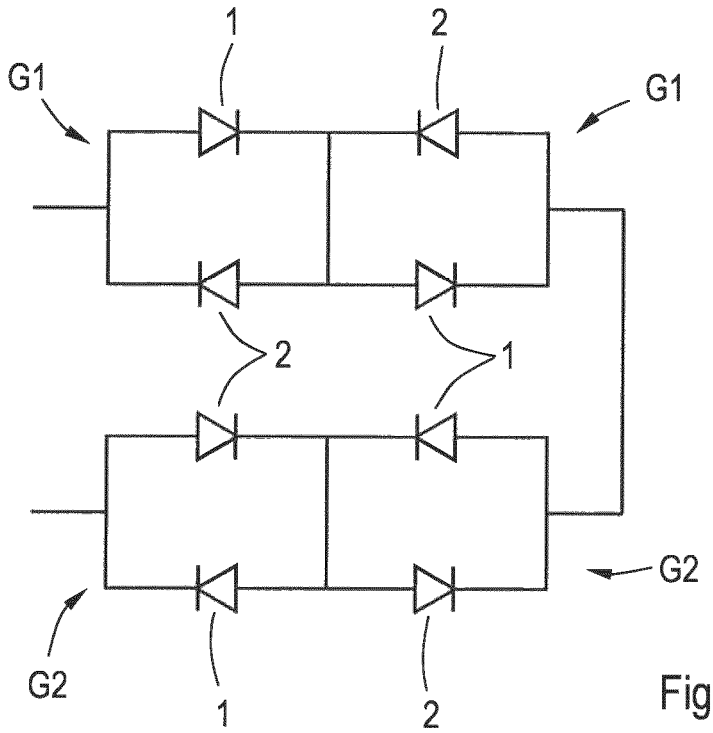
FIG. 6 is a circuit diagram illustrating a variant of the embodiment of FIG. 5B.

However, it is also possible to arrange the LEDs as illustrated in FIG. 6, according to the following pattern:

| | |
|---|---|
| 1 | 2 |
| 2 | 1 |
| 2 | 1 |
| 1 | 2 |

Figure 7:
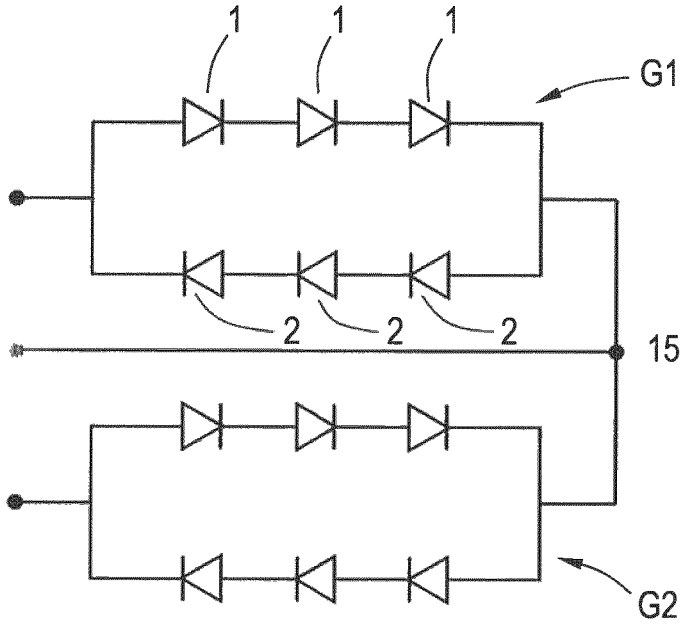
FIG. 7 is a circuit diagram of an exemplary embodiment of a light system with multiple first and second LEDs in a single group.

FIG. 7 illustrates a further exemplary embodiment, wherein the first group G1 comprises a plurality of first LEDs 1 connected in anti-parallel with a plurality of second LEDs 2; and wherein the second group G2 comprises a plurality of first LEDs 1 connected in anti-parallel with a plurality of second LEDs 2. However, in order to avoid breakdown risks it is generally not preferred to include too many first or second LEDs 1, 2 in series within a single group. The groups G1, G2 may be controlled in a similar manner as described above.

Figure 8A:
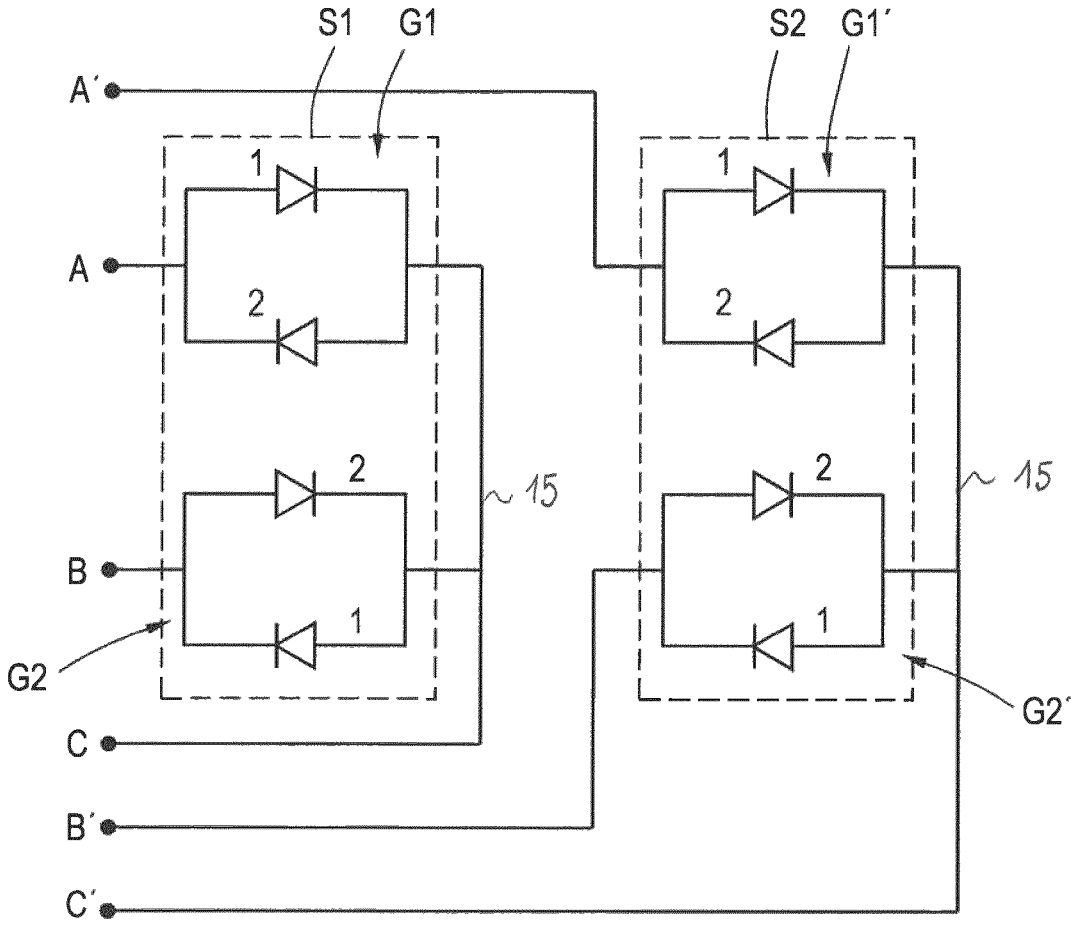
FIG. 8A-8C illustrate various exemplary embodiments combining a plurality of sets of four LEDs, with each set comprising a first and a second group connected in series.

FIG. 8A illustrates an example where two sets S1, S2 each comprising at least one first group G1, G1' and at least one second group G2, G2', are combined in a light system. As shown, the connection lines may be arranged without the need for any bridges. The first set S1 with the groups G1, G2 may be controlled via lines A, B, C as described above, e.g. as in FIG. 1B. The second set S2 with the groups G1', G2' may be controlled via lines A', B', C' as described above, e.g. as in FIG. 1B. Such an embodiment allows to individually control eight LEDs using six channels A, B, C, A', B', C'.

Figure 8B:
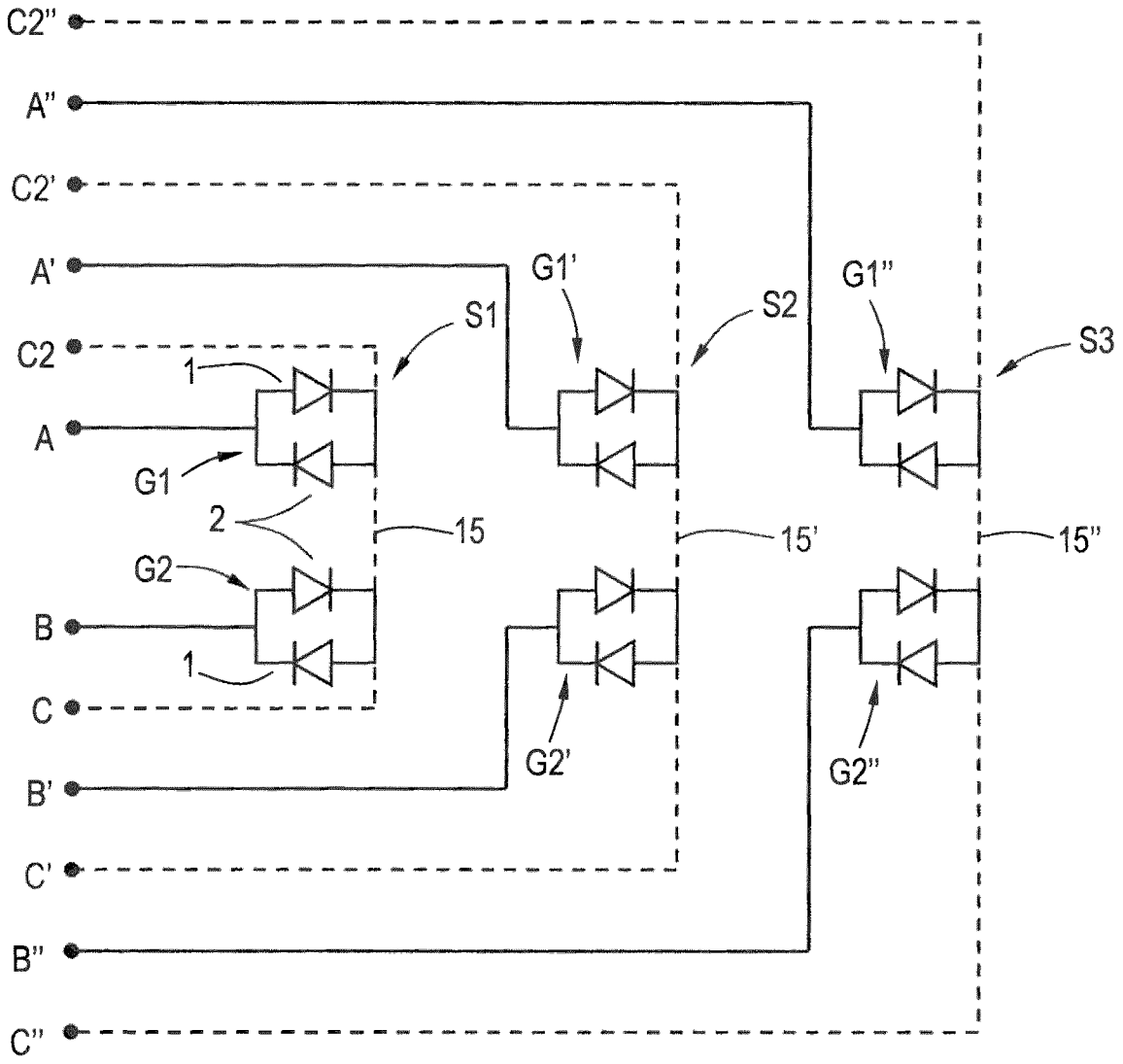
Figure 8C:
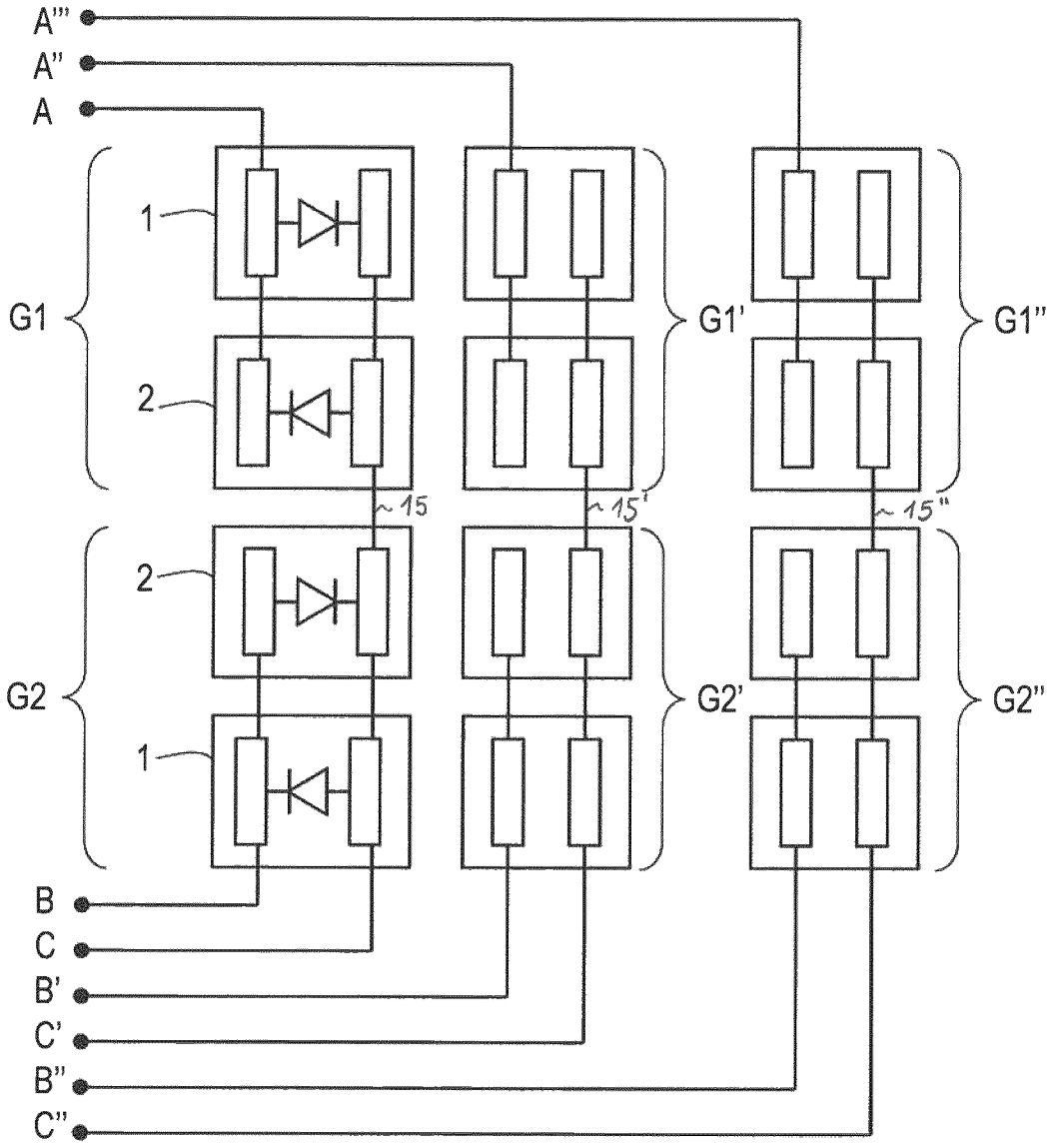
Figure 9:
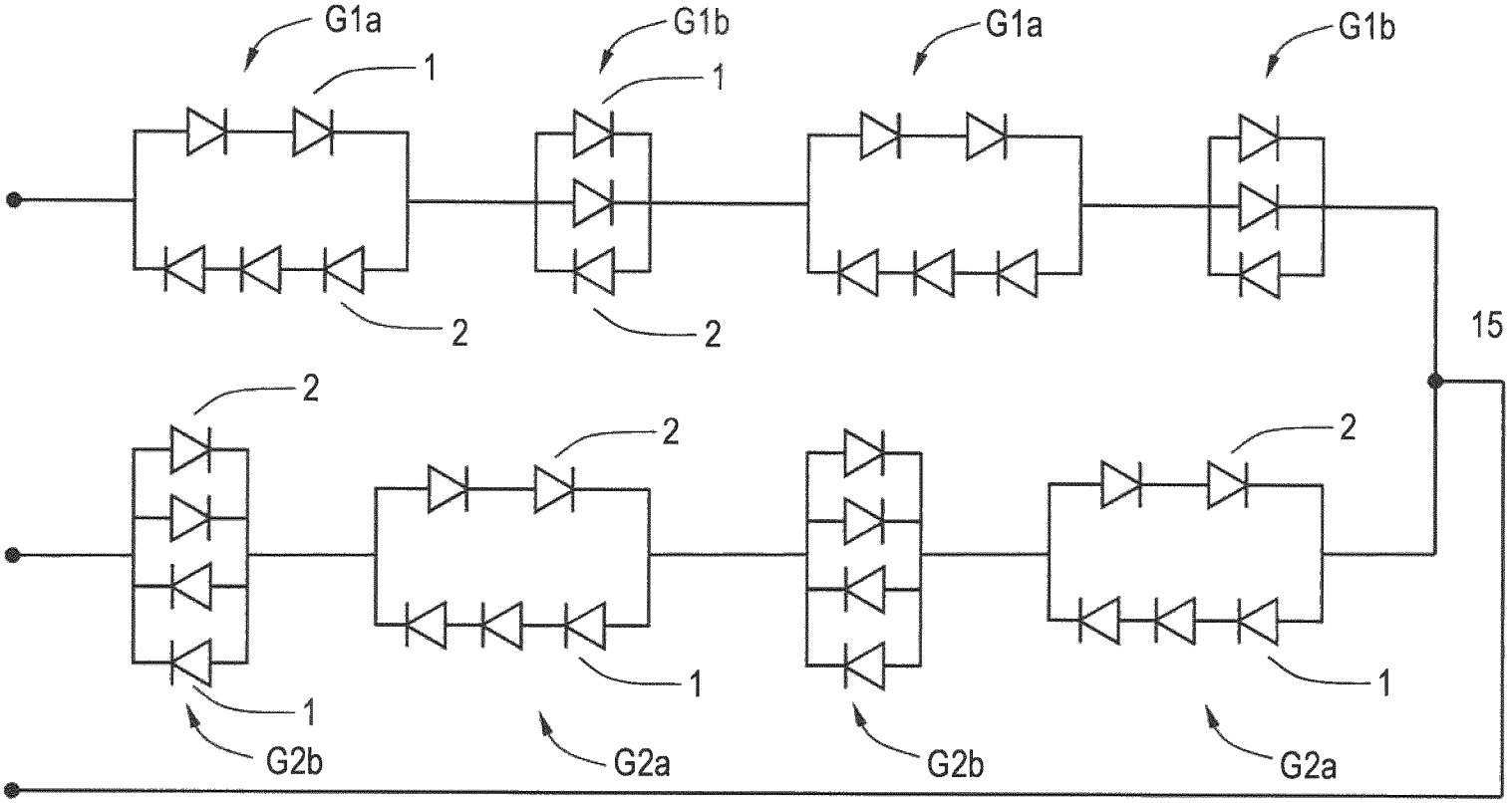
FIG. 9 is a circuit diagram of a more complex exemplary embodiment illustrating that many variations of the previously described embodiments are possible.

FIG. 8B illustrates another example where three sets S1, S2, S3 each comprising at least one first group G1, G1', G1" and at least one second group G2, G2', G2" are combined in a light system. As shown, the connection lines may be arranged without the need for any bridges. The first, second and third set S1; S2; S3 may be controlled via respective lines A, B, C; A', B', C'; A", B", C" as described above, e.g. as in FIG. 1B. As illustrated in dotted lines, it is possible to provide intermediate connection lines 15, 15', 15" which connect the first groups G1, G1', G1" and the second groups G2, G2', G2", on the PCB. Alternatively, additional connection lines C2, C2', C2" may be provided, and the connection between C, C', C" and C2, C2', C2", respectively, may be done outside of the PCB, e.g. in the invertor. Such an embodiment allows to individually control twelve LEDs using nine channels A, B, C, A', B', C', A", B", C". FIG. 8C shows the example of FIG. 8B in schematic form to further illustrate the compactness of embodiments of the invention. FIG. 9 illustrates yet another exemplary embodiment in which different first groups G1*a*, G1*b* are combined with different second groups G2*a*, G2*b*. The multiple first groups G1, G1*b* are connected in series with each other. Similarly, the multiple second groups G2*a*, G2*b* are connected in series with each other. The skilled person understands that many different implementations can be envisaged using those principles. The groups G1*a*, G1*b*, G2*a*, G2*b* may be controlled in any one of the manners described above.

In all embodiments of the figures, the first LED 1 and the second LED 2 may be the same or different. Also, the first LED 1 of the first group G1 may be the same as or different from the first LED 1 of the second group G2. Also, the second LED 2 of the second group G2 may be the same as or different from the second LED 2 of the second group G2. In most examples a single first LED 1 is shown to be connected in anti-parallel with a single second LED 2. However, as shown in FIG. 9 for groups G1*b* and G2*b*, it is also possible to have a group with multiple first LEDs 1 connected in parallel and/or with multiple second LEDs 2 connected in parallel, wherein the first LED(s) are connected in anti-parallel with the second LED(s). Also, embodiments of the invention may use LED components housing a plurality of LEDs 1 and/or 2 connected in parallel, in anti-parallel, or in series.

The first and second LEDs 1, 2 may be any one of the following: a red LED, a green LED, a blue LED, a white LED, a warm white LED, a cool white LED, etc. Optionally the LEDs may comprise a phosphor coating.

The first LED 1 and the second LED 2 may have substantially the same forward biasing voltage. The first LED 1 may have a phosphor coating which is the same as or different from a phosphor coating of the second LED 2. Also, some first and/or second LEDs 1, 2 may have a phosphor coating and other first and/or second LEDs 1, 2 may not have a phosphor coating.

The skilled person understands that the first and second LEDs 1, 2 of the at least one first and second group G1, G2 may be arranged in any suitable manner on a support, typically a PCB. Optionally, the first and second LEDs 1, 2 of the at least one first and second group G1, G2 may be arranged in an array comprising at least two rows and at least two columns, see for example the embodiments of FIGS. 4A and 4B. Preferably, when multiple first and second groups are provided, also the groups are arranged in an array comprising at least two rows and at least two columns. The distance between a first and a second LED within a same group may be different from the distance between two adjacent first LEDs from different groups.

By choosing an appropriate position for the LEDs 1, 2 in the array on the PCB a different light output can be achieved with different control schemes as described above. A different light output may refer to a different light pattern on the ground, a different color, a different color temperature, a different intensity, a different flashing pattern, etc.

In the embodiments of the figures, preferably, the control circuitry 20 is configured to receive a desired light pattern and/or a control parameter as an input, to select a control scheme out of a plurality of different stored control schemes in accordance with the input, and to control the control circuitry 20 in accordance with the selected control scheme. The plurality of different stored control schemes may correspond with two or more of the modes described above. The control circuitry 20 may comprise any one or more of the following: a field programmable gate array, an ASIC, a microcontroller, control switches. Those components are then configured to implement the various control schemes. FIG. 2 illustrates a possible implementation, but the skilled person understands that many other implementations are possible.

Optionally, the driver 10 may comprise dimming circuitry configured to change the DC current in function of a dimming input. In that manner, the light intensity of the light emitted by the LEDs which are switched on can be regulated. Optionally, the driver 10 is further configured to deliver a supply voltage for the control circuitry 20.

The invention further relates to a luminaire comprising a light system according to any one of the embodiments described above. The luminaire comprises a luminaire head, and optionally a luminaire pole. The luminaire head may be connected in any manner known to the skilled person to the luminaire pole. In other embodiments, the luminaire head may be connected to a wall or a surface, e.g. for illuminating buildings or tunnels. The luminaire head comprises a luminaire housing in which one or more supports, typically one or more PCBs 40, 40', with the LEDs 1, 2 are arranged. The driver 10 may be arranged in or on a luminaire head, in or on the luminaire pole, or in any other suitable location of the luminaire system. Preferably, the control circuitry 20 is arranged in the luminaire head.

Whilst the principles of the invention have been set out above in connection with specific embodiments, it is to be understood that this description is merely made by way of example and not as a limitation of the scope of protection which is determined by the appended claims.

The invention claimed is:

1. A light system, comprising:

a driver configured to generate a DC current, at least one first group, a first group thereof comprising a first and a second LED connected in anti-parallel, at least one second group, a second group thereof comprising a first and a second LED connected in anti-parallel; said at least one second group being connected in series with said at least one first group, and control circuitry configured for selectively operating the at least one first group and the at least one second group in at least one first mode and at least one second mode, wherein in the at least one first mode, the DC current is used to activate the first LED(s) of at least one of: the at least one first group or the at least one second group, in the at least one second mode, the DC current is used to activate the second LED(s) of at least one of: the at least one first group or the at least one second group, the light system further comprising:

a first optical element overlaying the first and second LED of the first group; and a second optical element overlaying the first and second LED of the second group; or at least two optical elements integrated in a single optical plate, wherein an optical element of the at least two optical elements overlays a single LED or multiple LEDs, wherein each optical element is a lens having a lens portion with a concave or convex surface.

2. The light system according to claim 1, wherein the at least one first group comprises at least two first groups connected in series.

3. The light system according to claim 1, further comprising an optical plate with a plurality of optical elements, wherein each first and/or second group is associated with an optical element of said optical plate.

4. The light system according to claim 1, wherein the at least one first mode comprises at least two of the following:

a common first mode wherein the first LEDs of the at least one first group and the at least one second group are activated;

a first mode wherein the first LED(s) of the at least one first group are activated and the first LED(s) of the at least one second group are not activated;

a further first mode wherein the first LED(s) of the at least one second group are activated and the first LED(s) of the at least one first group are not activated;

and/or wherein the at least one second mode comprises at least two of the following:

a common second mode wherein the second LEDs of the at least one first group and the at least one second group are activated;

a second mode wherein the second LED(s) of the at least one first group are activated and the second LED(s) of the at least one second group are not activated;

a further second mode wherein the second LED(s) of the at least one second group are activated and the second LED(s) of the at least one first group are not activated.

5. The light system according to claim 1, wherein the first and second LED of the first group each have a first terminal connected to a first common line portion, and wherein the first and second LED of the second group each have a first terminal connected to a second common line portion.

6. The light system according to claim 1, wherein the control circuitry is configured for at least one of:

switching between a first mode of the at least one first mode and a second mode of the at least one second mode, such that the DC current provided by the driver before, during, and after the switching, is substantially the same; and receiving the DC drive current from the driver and directing the DC current through the at least one first and/or second group, without dimming, in accordance with a first or second mode of the at least one first and second mode.

7. The light system according to claim 1, wherein the control circuitry comprises at least a first branch with two switching elements connected in series, and a second branch with two switching elements connected in series, said first branch being connected in parallel with said second branch between a first current line for receiving the DC current from the driver and a second current line, wherein a first intermediate node between the two switching elements of the first branch is connected to the first group and a second intermediate node between the two switching elements of the second branch is connected to the second group.

8. The light system according to claim 7, wherein the control circuitry further comprises a third branch with two switching elements connected in series, said third branch being arranged in parallel with the first and second branch, wherein a third intermediate node between the two switching elements of the third branch is connected to an intermediate node between the at least one first group and the at least one second group.

9. The light system according to claim 1, wherein the control circuitry is configured to:

receive at least one of: a desired light pattern or a control parameter, as an input, to select a control scheme out of a plurality of different stored control schemes in accordance with the at least one of: the desired light pattern or the control parameter; and control the control circuitry in accordance with the selected control scheme.

10. The light system according to claim 1, wherein the first LED and the second LED have substantially the same forward biasing voltage.

11. The light system according to claim 1, wherein the first group comprises a plurality of first LEDs connected in anti-parallel with one or more second LED(s); and/or wherein the second group comprises a plurality of first LEDs connected in anti-parallel with one or more second LED(s).

12. The light system according to claim 1, wherein the first LED is different from the second LED.

13. A luminaire comprising a light system according to claim 1.

14. A light system, comprising:

a driver configured to generate a DC current, at least one first group, a first group thereof comprising a first and a second LED connected in anti-parallel, at least one second group, a second group thereof comprising a first and a second LED connected in anti-parallel; said at least one second group being connected in series with said at least one first group, and control circuitry configured for selectively operating the at least one first group and the at least one second group in at least one first mode and at least one second mode, wherein in the at least one first mode, the DC current is used to activate the first LED(s) of the at least one first group and/or the at least one second group, in the at least one second mode, the DC current is used to activate the second LED(s) of the at least one first group and/or the at least one second group, wherein the first and second LED of the first group each have a first terminal connected to a first common line portion, and wherein the first and second LED of the second group each have a first terminal connected to a second common line portion; and wherein the first and second LED of the first group each have a second terminal which is connected to a further common line portion in line with the first common line portion, and wherein the first and second LED of the second group each have a second terminal which is connected to a further common line portion in line with the second common line portion.

15. A light system, comprising:

a driver configured to generate a DC current, at least one first group, a first group thereof comprising a first and a second LED connected in anti-parallel, at least one second group, a second group thereof comprising a first and a second LED connected in anti-parallel; said at least one second group being connected in series with said at least one first group, wherein the at least one first group and the at least one second group are arranged on a PCB, and control circuitry configured for selectively operating the at least one first group and the at least one second group in at least one first mode and at least one second mode, wherein in the at least one first mode, the DC current is used to activate the first LED(s) of at least one of: the at least one first group or the at least one second group, in the at least one second mode, the DC current is used to activate the second LED(s) of at least one of: the at least one first group or the at least one second group, the light system further comprising a single optical element overlaying the first and second LEDs of the first group and the second group, wherein the single optical element is a lens having a lens portion with a concave or convex surface, and wherein the single optical element is part of an optical plate arranged above the PCB.

* * * * *